US009802083B2

(12) United States Patent
Martino

(10) Patent No.: US 9,802,083 B2
(45) Date of Patent: Oct. 31, 2017

(54) DISCUS LAUNCHED FLYING FOOTBALL

(71) Applicant: Marc Gregory Martino, Westlake Village, CA (US)

(72) Inventor: Marc Gregory Martino, Westlake Village, CA (US)

( * ) Notice: Subject to any disclaimer, the term of this patent is extended or adjusted under 35 U.S.C. 154(b) by 30 days.

(21) Appl. No.: 15/080,505

(22) Filed: Mar. 24, 2016

(65) Prior Publication Data

US 2016/0206931 A1 Jul. 21, 2016

Related U.S. Application Data

(63) Continuation-in-part of application No. 14/261,563, filed on Apr. 25, 2014, which is a continuation-in-part of application No. 13/046,089, filed on Mar. 11, 2011, now Pat. No. 8,777,785.

(60) Provisional application No. 61/341,124, filed on Mar. 26, 2010, provisional application No. 61/816,812, filed on Apr. 29, 2013, provisional application No. 62/139,690, filed on Mar. 28, 2015.

(51) Int. Cl.

| | |
|---|---|
| ***A63H 27/00*** | (2006.01) |
| ***A63B 43/00*** | (2006.01) |
| ***A63H 33/18*** | (2006.01) |
| ***A63H 27/14*** | (2006.01) |

(52) U.S. Cl.

CPC ..... *A63B 43/002* (2013.01); *A63H 27/14* (2013.01); *A63H 33/18* (2013.01)

(58) Field of Classification Search

CPC A63B 43/002; A63B 2243/007; A63H 27/14; A63H 33/18

USPC ..... 473/570

See application file for complete search history.

(56) References Cited

U.S. PATENT DOCUMENTS

| | | | | |
|---|---|---|---|---|
| 4,605,183 | A * | 8/1986 | Gabriel | A63H 27/007 244/46 |
| 5,269,514 | A * | 12/1993 | Adler | A63B 43/002 273/DIG. 20 |
| 5,284,341 | A * | 2/1994 | Routzong | A63B 43/00 273/DIG. 20 |
| 5,458,329 | A * | 10/1995 | Bushman | A63B 43/002 273/DIG. 8 |
| 5,779,576 | A * | 7/1998 | Smith, III | A63B 65/00 473/570 |
| 6,669,587 | B2 * | 12/2003 | Kessler | A63B 43/002 473/570 |
| 8,187,126 | B2 * | 5/2012 | Martino | A63B 43/00 473/570 |

(Continued)

*Primary Examiner* — Allen Chan

(74) *Attorney, Agent, or Firm* — Hackler Daghighian Martino & Novak

(57) ABSTRACT

A throwing and/or catching toy includes a generally elongated spheroidal body defining a longitudinal axis. A length of the body is longer than an equatorial diameter. A lift-generating wing is non-movably attached to the body near and/or at a center of the wing. At least one finger hold extension extends from a distal end of either a left or right wing portion. The finger hold extension is configured to allow a user to throw the toy in a discus-launched manner and the body is configured to be caught by the user. The lift-generating wing may be made as an injection molded, polymer wing. A manual adjuster may be associated with and controlling the shape of a horizontal stabilizer. A front end of the elongated body may be a resilient foam having a Shore A durometer hardness equal to or less than 25.

28 Claims, 4 Drawing Sheets

(56) References Cited

U.S. PATENT DOCUMENTS

| | | | | |
|---|---|---|---|---|
| 8,777,785 | B2 * | 7/2014 | Martino | A63H 27/00<br>473/570 |
| 2001/0039221 | A1 * | 11/2001 | Schneider | A63B 41/00<br>473/614 |

* cited by examiner

DISCUS LAUNCHED FLYING FOOTBALL

CROSS-REFERENCE TO RELATED APPLICATIONS

This non-provisional application claims priority to provisional application 62/139,690 filed on Mar. 28, 2015. This non-provisional application is also be a continuation-in-part of application Ser. No. 14/261,563 filed on Apr. 25, 2014 which itself claimed priority to provisional application 61/816,812 filed on Apr. 29, 2013. Application Ser. No. 14/261,563 was also a continuation-in-part to application Ser. No. 13/046,089 filed on Mar. 11, 2011 (now U.S. Pat. No. 8,777,785 issued on Jul. 15, 2015), which itself claimed priority to provisional application 61/341,124 filed on Mar. 26, 2010. The entire contents of all of the applications mentioned herein above are incorporated in full by these references.

FIELD OF THE INVENTION

The present invention generally relates to flying toys. More particularly, the present invention relates to a football that is part glider and can be thrown discus-style.

BACKGROUND OF THE INVENTION

Application Ser. No. 14/261,563 generally taught a new toy which was disclosed as a throwing and catching flying toy. This toy was commonly referred to either as the Flying Football, the Wing-It Football or the Gliding Football. The throwing and catching flying toy included a structural support attached with a lift-generating wing. A body which is used to throw and catch the toy was rotatably attached to the support. A tail and tail fin were connected either to the body or the structure and provides stability in the air, much as a tail fin on an airplane does. The body spins in the air when thrown similar to a football, yet the structural support and wings remain level during flight for producing lift. The result is the farthest flying football, allowing users to greatly increase the distance thrown.

Referring now to FIGS. 9-20 of the '563 application, a throwing and catching flying toy 300 is commonly referred to either as the Flying Football, the Wing-It Football or the Gliding Football. The throwing and catching flying toy 300 comprises a structural support 302 including a lift-generating wing 304 attached relative to the support 302. A body 306 is rotatably attached relative to the support 302, wherein the body 306 comprises a front section 308 fixed relative to a rear section 310. Both the front section 308 and rear section 310 rotate about a longitudinal axis 312. A tail 314 is located relative to either the support 302 or the body 306 extending in a direction beyond the rear section 310 of the body 306. A tail fin 316 is attached relative to a tail end 318.

In exemplary embodiments, the body 306 may comprise a generally oblate spheroidal or football shape. It is also to be understood that the body 306 can be formed to resemble other various shapes, such as missile, rockets or other combinations thereof. The rear section 310 is formed such that a person can grasp the toy 300 within their hand and then throw the toy 300 in a similar motion in how a football is thrown. The front section 308 is formed such that it is easy to catch, in a similar manner as to how a football is caught.

In some embodiments, as shown in FIGS. 12-14 of the '563 application, the front section 308 and rear section 310 may be formed as a single body 306. In other embodiments, as shown in FIGS. 9-11 and 15-18 of the '563 application, the front section 308 may be formed separate from the rear section 310, while the sections are still fixedly connected. More specifically, the support 302 may be located between and separate the front section 308 and the rear section 310. In some embodiments, as shown in FIGS. 9-11, the rear section 310 may be smaller in diameter than the front section 308. This is so because it is easier to grasp a smaller diameter rear section 310 for throwing, and it is also easier to catch a larger front section 308 when catching the toy 300. In another embodiment, as shown in FIGS. 15-18, the front section 308 and rear section 310 are the substantially the same diameter such that the transition between the sections does not vary in shape and diameter.

The body 306 is rotatable with respect to the support 302. This is most easily accomplished with a bearing 322. It has been found that the bearing 322 should be of a very low friction. This can be accomplished with a relatively loose fitting roller ball bearing which does not have grease. Grease imparts enough friction that the body 306 does not freely rotate. Other low friction bearings are suitable replacements if the friction of the bearing is low enough. The bearing 322 is most easily seen in FIG. 18 of the '563 application. FIG. 18 shows how the bearing 322 allows the front section 308 and rear section 310 to rotate freely about the support 302.

A thumb grip 320 may be fixed relative to the support 302 and located along and adjacent to the rear section 310 of the body 306. The thumb grip 320 is shaped and formed such that a user's thumb presses the thumb grip 320 while the toy 300 is held. Due to the low friction of the bearing 322, the structural support 302 and wing 304 would rotate when the toy 300 was held before a throw. The thumb grip 320 allows the body 306 to be temporarily fixed relative to the support 302. Once the toy 300 is in the air, the thumb grip 320 is released and the body 306 is able to rotate freely. In the various embodiments, the thumb grip 320 extends from the support 302 and is positioned just above the rear section 310. In FIGS. 9-11 and 15-17 of the '563 application the thumb grip 320 starts at the support 302 and moves rearward over the rear section 310. In FIGS. 12-14 of the '563 application the thumb grip 320 starts at the support and moves forward over the rear section 310. The thumb grip 320 is also positionable on either side of the support 302 such that it can be used for either a right-handed thrower or a left-handed thrower. Additionally, the thumb grip 320 can be positioned at various locations on each side of the support 302 such that it can be sized for people of varying hand sizes. For instance, an adult has a larger hand and might want to move the thumb grip 320 further over as compared to a child with a smaller hand.

In an exemplary embodiment, the wing 304 may be pivotably adjustable in a pitch axis 324 relative to the support 302. Adjusting the pitch of the wing 304 is necessary to trim the toy 300 in flight. If the pitch is too great, the toy 300 may fly in an upward arc and then stall before it reaches the intended receiver. If the pitch is too less, the toy 300 may fly downwards and crash into the ground prematurely. The right amount of pitch is necessary such that the toy 300 can fly in a long and straight flight path.

To achieve this adjustability the wing 304 may be pivotably adjustable with respect to the structure 302. FIG. 18 of the '563 application best shows how this pivotable adjustment could operate, as there are a multitude of methods one skilled in the art could devise. The wing 304 is pivotable about a pivot 326. The wing 304 is biased against the pivot 326 by a bias 330, or also a spring means or a rubber band. The pitch of the wing 304 is therefore adjusted by a screw 328. As the screw 328 threads into the wing 304, it causes the whole wing 304 to either pitch up or pitch down relative to the support 302. The toy 300 can be thrown and adjusted to achieve the right amount of overall pitch.

Another feature of the design of FIG. 18 of the '563 application is that the wing 304 can also be a breakaway wing 304. This means that the wing 304 can come apart from the support 302 and be easily replaced. For instance, when the toy 300 crashes, a wing that is fixedly attached might snap and break. To prevent this, the wing 304 is held in place with the bias 330. When the bias 330 is overcome, the wing 304 simply comes apart from the support 302. Then the wing 304 can be reattached to the support 302 for further play. It is to be understood by one skilled in the art that a multitude of designs can be devised where the wing 304 is breakaway and this disclosure is not intended to limit it to the precise form described and shown herein.

Another feature of the exemplary embodiments may incorporate a wing 304 that has an amount of dihedral built in. Dihedral is best shown in FIGS. 11, 14, and 17 of the '563 application. The dihedral angle 332 is a measure of the angle between the wing that is horizontal (or imaginary horizontal plane 382) and the wing that is angled upwards. A wing that has an amount of dihedral built into it is inherently stable. As one side of a wing tips downward and becomes more aligned along a horizontal plane, it essentially generates more lift, which then causes it to rise. Dihedral helps to keep the toy 300 flying level and causes the support 302 and the wing 304 to remain upright while the rest of the body 306 rotates during flight. The wing 304 may be broke apart into two separate halves as is shown in FIGS. 9-11, or the wing 304 may comprise one single wing 304 with a horizontal section 334 joined by two dihedral sections 336 as is shown in FIGS. 14-17. The dihedral angle 332 can be a variety of angles, such as 10 degrees or 20 degrees. The more the dihedral angle 332, the more stability is increased while an amount of overall lift is lost.

Another feature of the exemplary embodiments is placing the wing 304 above the center of gravity of the toy 304 or above the longitudinal axis 312. By placing the wing 304 above the center of gravity, it makes the toy 300 inherently stable. Placing the wing 304 below the longitudinal axis or below the center of gravity would make the toy 300 inherently unstable. The high placement of the wing 304 combined with the dihedral angle 332 makes the toy 300 stable in flight.

The tail 314 can extend rearward from either the support 302 as shown in FIGS. 12-14 of the '563 application, or the tail 314 can extend from the rear section 310 of the body 306 as shown in FIGS. 9-11 and 15-18 of the '563 application. When the tail 314 extends from the support 302, the tail 314 is stationary in that it doesn't rotate with the body 306. When the tail 314 extends from the rear section 310 of the body 306, the tail 314 rotates with the body 306.

The tail fin 316 may be attached to the tail end 318. The tail fin 316 may be either fixedly attached or rotatably attached to the tail end 318. FIGS. 19-20 of the '563 application show an embodiment where the tail fin 316 is rotatably attached to the tail end 318. Bearings 322 may be used to rotatably attach the tail fin 316 to the tail end 318. The tail fin 316 may be comprised of two vacuum-formed plastic parts 338 that are fastened together to capture the bearings 332. For instance, the vacuum-formed plastic parts may be comprised of polycarbonate sheets which are either 10, 15 or 20 thousands of an inch thick. This allows the tail fin 316 to remain light and durable. It is essential for stability that the tail assembly of the toy 300 remain light such that it causes the body 306 of the toy 300 to straighten during flight. Through testing an overly heavy tail assembly shows bad stability during flight and can become uncontrollable. In another embodiment, the tail fin 316 can be angled such that during forward flight, it induces the tail fin 316 to spin. In another embodiment, the tail fin 316 can be a plurality of tail fins 316. As be understood by one skilled in the art a variety of tail designs can be formed as this disclosure is not intended to limit it to any of the precise forms shown and described herein.

The throwing and catching flying toy 300 is the farthest flying football due to the lift-generating wing 304 which allows the toy 300 to actually fly like a glider once thrown in the air. All footballs are simply rotating projectiles. A projectile will travel a set distance that is dependent upon its aerodynamic resistance, exit velocity, overall weight, rotational velocity and various other factors. One variable that is not a factor is lift.

Lift is produced by a wing profile. The reason a football and a wing haven't been combined is that a football body rotates while a wing cannot rotate. A wing can only generate lift if it doesn't rotate and stays relative to the ground. The solution is to allow part of the football to rotate, while allowing the wings to stay stationary.

The center of gravity of the toy 300 in relation along the longitudinal axis 312 should be substantially in the middle of the rear section 310 or near a location between the front section 308 and rear section 310. This means that when the toy 300 is held in the throwing hand about the rear section 310, the center of gravity should be located in the center of the hand as well, but not behind the hand. This allows for a good feeling for throwing the toy 300. If the center of gravity is behind the throwing hand, it is extremely difficult to throw correctly. Therefore, getting the center of gravity within the correct location is critical to making the toy 300 easy to throw.

Another exemplary embodiment not shown would be the integration of the Jetball into the Flying Football. This exemplary embodiment would include the lift-generating wing characteristics of the Flying Football, with the self-propelled characteristics of the Jetball.

Provisional application 61/816,812 filed on Apr. 29, 2013 showed in FIGS. 1-3 another exemplary embodiment of the present invention. As compared to FIGS. 9-20 of this application, the football body of the '812 application did not rotate. The body was stationary with respect to the wings and tail section.

FIG. 4 of the '812 application showed an exploded perspective view of the structure of FIGS. 1-3. FIG. 4 showed it was comprised of a front foam section and a rear foam section separated by a plastic piece. Separating the football body into two sections had the advantage that the foams can comprise different materials. For instance, the front foam can be a soft type foam that is configured to absorb impact loads when the football is caught by a catcher or strikes an object, such as a tree, a car, another person or the ground. The front foam can comprise a soft and resilient type of foam that gives under load but bounces right back after the force is removed. The durable and resilient foam also lessens the g-loads experienced by the rest of the product during a crash.

The rear foam does not have to be the same type of foam as the front foam. The rear foam can be comprised of a stiffer and lighter material such as EPP, EPS or EPO foam. These foams are significantly lighter than as compared to the front foam and help to keep the overall weight of the product low. The rear foam can also be stiffer such that a thrower of the football can get a good grip on the product.

The part separating the front and rear foam is fastened or attached to the center shaft that runs the length of the product. In this case the shaft is 15 mm diameter 7075-T6 aluminum. Through testing 10 mm diameter aluminum shafts were used. However, these shafts were constantly breaking and bending during use of the product. Increasing the diameter from 10 mm to 15 mm increases the overall strength of the aluminum shaft. Furthermore, the aluminum shaft is strong because it is made from 7075-T6 which is a very strong alloy of aluminum that has also undergone a heat treatment process to increase its strength.

The part separating the front and rear foam can be glued to the aluminum shaft, press fitted, or fastened to the shaft. When the football impacts an object, impact loads are transmitted through the front foam and to the middle part that then transmits the loads to the shaft. This means that for the most part, impact loads are not transmitted through the rear foam. The middle part can be injection molded. In this particular case the middle part is comprised of polypropylene (PP) due to its low density. The front foam can be glued to the middle part to ensure that the front foam stays attached to the rest of the product. The middle part is this embodiment is fastened to the shaft with a bolt and a nut (not shown).

Behind the rear foam is the wing bracket. FIGS. 5-6 of the '812 application are further exploded views of the body of the football. The wing bracket captures the rear foam between the middle part and the wing bracket. The wing bracket can also be attached to the center shaft in a multitude of ways but is shown here with a hole for a fastener (not shown). Through product testing a lot of force is transmitted through the wing bracket part. Typically prototype parts were made using ABS. However, ABS would snap and break due to fatigue. It was discovered that polycarbonate (PC) is an optimum choice for the wing bracket that reduces breaks and mechanical failure.

FIGS. 7-9 of the '812 application are various views showing the novel attachment means between the wings and the wing bracket. When the product strikes the ground or strikes a tree, a large amount of force is transmitted through the wings into the wing bracket. This area of attachment is a zone that is prone to failure. Using screws to primarily hold the wing to the wing bracket led to repeated failures. The embodiment here teaches to hard mount the wing to the wing bracket through a male-female feature that reduces the loads carried by a fastener. For instance, in these embodiments the wing bracket has a male section that is match fitted to fit within a female section on the wing. In this embodiment the male protrusion is shaped as an oval such that proper placement and location is automatic. The wings cannot move relative to the oval which locks the wings in place.

By placing one part inside of the other, impact loads are transmitted through the materials themselves and not through a fastener. Here, a fastener is still used but it is not a load carrying fastener. A bolt/screw/fastener can enter from above the wing and a nut can be placed within the channel located on the wing bracket. The fastener and nut simply help hold the wing onto the wing bracket, but no major impact loads are needed to flow through the bolt and nut. In this embodiment the hole that the nut is placed within is match sized such that a socket or a wrench needed to hold the nut in place is not needed. This simplifies the overall parts needed for a customer to assemble the product and reduces costs. The Applicant prefers to use a bolt/screw with a locknut. Lock nuts have nylon inserts that prevent unfastening due to vibration. Therefore, the hole in the wing and wing bracket is a through hole. A screw could be used, but then the screw would have to bite into the plastic of the wing or wing bracket. Threads would be formed by the screw and could create areas of stress localization that would result in premature failure. As can be seen, the male or female side could be switched between the wing and wing bracket. Also, many sizes and shapes of male-female features could be used that accomplish the same result.

At the rear of the wing bracket it is flat and has two extensions designed for placement of the first and middle finger. Because this particular embodiment does not spin, it is intended that the thrower of the product place his/her first and middle finger on the back of the wing bracket. The throwing action is then a mix between a football throw and that of a throw for a dart or a glider. The flat surface allows a great location to impart a large push force for extended throws.

FIGS. 10-13 of the '812 application show an embodiment of a tail section of the football. This particular design is configured to also act as an upright stand as best shown in FIGS. 11 and 12 of the '812 application. Both tail sections provide the needed stability to make the product fly straight during use. However, the horizontal tail is designed to be manually adjustable. A thumb screw (not shown) is configured to go into the rear protrusion on the horizontal tail. It has been discovered by the applicant that the product flies best when nose-heavy. This means that the center of gravity of the product is ahead of where the lift is generated by the wings. This means that if the horizontal tail was purely horizontal the product would nose dive to some extent. To counter-act this nose dive, the horizontal tail can be manually biased up through the thumb screw. The thumb screw threads through the protrusion on the horizontal tail and pushes against the center shaft. This then causes the horizontal tail to push down when in flight. The user can then adjust the balance of the football to achieve perfect flight characteristics. To help bias the horizontal tail against the center shaft, a rubber band or other bias means can be used. Here, a rubber band (not shown) can be placed around the protrusion on the horizontal tail and the shaft.

FIG. 13-15 of the '812 application shows another embodiment of the wing bracket. In this embodiment, the wing bracket was shortened and the finger push section raised. This was done to locate the finger push sections at the vertical center of gravity of the overall product. It is preferred to have the finger push section centered on the center gravity. However, the product still could work if it was centered within 0.5 inches or even 1.0 inch of the center of gravity. It was discovered in the embodiment shown in FIGS. 1-12 that the cg was higher/above the finger push areas. Therefore, when the football is thrown hard, the football would rotate upwards because the portion being pushed was below the center of gravity. As can be seen in the images, the bottom of the wing bracket it also contoured to allow access for a user hands to rest against and helps allow one to better hold and grasp the football. It is expected that the user places his first and middle finger along the back of the wing bracket. The thumb rests against the rear body of the football on one side while the ring finger and pinky finger rest on the opposite side of the rear body. The first finger and middle finger split the center shaft of the football. It is also noted that the finger push sections are also near the center of gravity with respect to the overall product when looking at it from front to back, or with respect to along the longitudinal axis. As one can see the finger push sections are also aligned with center of gravity left to right as well. Therefore, the finger push sections are aligned with the center of gravity in all three axes. This is believed to provide more reliable and consistent launches/throws by the thrower.

FIGS. 16-17 of the '812 application are yet another embodiment of a tail section where the horizontal tail is ahead of the vertical tail. Each tail section also includes a hex shaped recess for a locknut to be placed within. FIGS. 16-17 of the '812 application show a large tail section for increased stability. The horizontal tail also includes a protrusion for a thumb screw (not shown). A tailless version may be constructed that completely removes the horizontal and vertical tail. Winglets on the end of a main wing may be used in lieu of the vertical tail and wing twist may be used in lieu of the horizontal tail.

The wing of the football is also unique. Most RC aircraft use a foam or wood wing. These wings are easily deformed and broken during crash landings. These wings cannot stand up to the repeated use a football encounters. The applicant has invented a wing made from plastic. The wing is thin in that no substantial thickness is used. Typically wings have a thickness to them. However, a plastic wing with a thickness would be too heavy and impractical. Also, to keep manufacturing costs low, the applicant uses a single layer of plastic that is curved to produce a wing-like shape. Because the wing is made from a plastic, such as high-impact polystyrene (HIPS) or ABS it is stiff yet light enough. HIPS was found to be one of the optimal choices due to its stiffness in keeping its shape. However, later is was discovered that ABS was more optimal as it was not prone to cracking as much as HIPS. As can be seen, a variety of polymer choices could be used.

The wing is also specially shaped to improve aerodynamics and provide long, consistent throws. In the applicant's experience, one optimal configuration is for the wing to have about an 8 percent thickness measure from the bottom of the leading and trailing edges. The height of 8 percent is reached about 30 percent along the cord of the wing. Also, the angle of attack of the whole wing is at 2 degrees with a 2 degree downward twist of the wing moving from the center out. This means that at the tip the wing has zero angle of attack. This helps to keep stability during high angles of attack when the football is climbing at a high angle. Also, these wing measurements have provided long throws with substantial increase in distances thrown.

The middle section also is shown as having two legs or stands protruding. This allows the product to be placed on a surface and remain upright.

The wing also has a substantial amount of dihedral such that it adds to overall stability. The dihedral angle could be 5, 10, 15 or 20 degrees or some other variation thereof. The wings are also swept backwards to aid in stability and to also keep the wings behind the football body such that it is easier to catch.

It is also contemplated that one embodiment of the football could include active surfaces to keep it aligned and straight. These adaptive/active surfaces could include a gyro/sensor that controls a servo and a flap, such as is done with radio controlled aircraft.

In another embodiment, a football could include a height sensor to keep the football flying about chest level throughout its flight. A sensor could determine whether the football was too high or too low and make an adjustment.

It was also discovered during testing of other versions with a rotating football body that gyroscopic precession can cause the football to turn in the air. This therefore means that to neutralize this affect, the center of gravity of the rotating body/mass along the longitudinal axis should coincide with the center of the lift being generated such that no gyroscopic precession exists. A preferred embodiment may include forward swept wings such that the center of gravity of the rotating mass will be aligned with the center of the lift being generated. In this way the product can have its gyroscopic precession minimized to the point where it has no noticeable affect or to the point where it is eliminated.

In another embodiment, the football could include active control surfaces controlled by a transmitter similar to an RC aircraft. A person throwing and a person catching the product could each control the football, preferably one at a time. Because the transmitter is typically held and controlled by one's hands, this would be impractical for a football. Therefore, a transmitter could be integrated into a hat or a headband. Control of the football would be done by tilting one's head forward/backward or left/right. Sensors in the hat/headband could sense movement and then transmit them to the football. A switch on the football could be switched such that control from only one headband is allowed at any one time.

A baseball version of the product is also possible, as many of the technologies and lessons learned can be applied to a baseball version. For instance, the football body could be replaced with a baseball body. Also, the body could be a double baseball configuration with a forward baseball body for catching and a rearward baseball body for throwing.

Moving from the refinements and improvements made in the '812 provisional application, more improvements are disclosed herein as shown in FIGS. 34-50 of the '563 application. The embodiments shown in FIGS. 34-50 are very close as the version that will go into production. A throwing or catching toy 300 has a generally elongated spheroidal body 306. The body 306 can be defined as having a longitudinal axis 312, where a length 307 of the body along the longitudinal axis 312 between a front end 311 of the body 306 to a back end 313 of the body 306 is longer than an equatorial diameter 309.

The equatorial diameter 309 is generally aligned with a center 319 of the body 306. The center 319 is disposed along the longitudinal axis 312. The center 319 may not evenly split the distance from the front of the body 311 to the rear of the body 313 depending on the shape of the body 306. This is the case with the present embodiment where the football shaped body 306 has a bullet shape.

It has been learned that various prior art patents and texts refer to a football shape as either being an oblate spheroid or a prolate spheroid. It is now believed that a prolate spheroid is the proper geometrical description, however as used herein in previous applications and this application, both prolate spheroid and oblate spheroid have the meaning that the body 306 is elongated like a football such that is cuts through the air better being more aerodynamic while also resembling a football. It is also understood herein that football refers to American football and not the game of soccer where a soccer ball is completely round.

A lift-generating wing 304 is non-movably attached to either the body 306 or to a support 302. The support 302 is non-movably attached to the body 306. In this embodiment, the front end 311 of the body 306 comprises a front end 315 of the toy where the support 302 is not disposed through the front end 311 of the body 306. The toy 300 is easier to catch when the front end 315 of the toy is just the football shape without the support 302 protruding or extending therethrough. In this manner the body 306 is configured to be thrown and caught by a user.

In this embodiment, it is preferred that the equatorial diameter 309 is at least 3.5 inches. 3.5 inches in diameter is larger than a typical RC aircraft fuselage but smaller than a full size football. If the equatorial diameter 309 was less than 3.5 inches, it would improve aerodynamic drag however it would be at the expense of ease of catching the toy 300. The product is still a throwing and catching product and consideration to ease of catching must still be a valid concern. Some products in the marketplace are simply too small and easily pass through the open hands of a receiver/user only to hit the receiver in the head or body. It is understood to those skilled in the art that it is possible to make the equatorial diameter about 2 inches, 2.5 inches, 3 inches, 3.5 inches, 4 inches, 4.5 inches or any value within such stepped increments.

This embodiment has the body 306 broken up into a front section 308 and a rear section 310. The front section 308 is designed and configured to reduce the impact loads upon the toy 300 and prevent injury to the users. One of the major hurdles in perfecting the toy 300 was making a structure and design that could withstand the abuse of repeated crashes and hard landings while still flying straight and true. Part of the solution is to make the front section 308 soft to the touch or to absorb energy. This means that at least a portion of the front end 311 of the body 306 or the entire front section 308 be made to have a Shore A durometer hardness substantially equal to or less than 25. For instance an EVA style foam may be a good choice for the front section 308. The upper limit of the Shore A hardness should remain at or below 35. A Shore A hardness at or less than 25 is optimum. It is also understood that a Shore A hardness of 20, 15 or 10 would also work and provide great energy absorbing characteristics. These values provides a good balance of sufficient stiffness while also having sufficient compression for reducing impact loads. As can be seen the front section 308 of the body 306 is football shaped providing good aerodynamics while also being aesthetically pleasing.

Due the material of the front section 308, it is typically quite heavy. It is preferred that an overall weight of the toy is less than 400 grams. It is even more preferred if the overall weight is at or less than 350 grams. Better yet, it is optimum if the overall weight is at or less than 300 grams. It is also preferred that the overall weight remain above 200 grams or better yet 250 grams. When the weight goes down, the toy 300 remains in the air longer as the lift being generated by the wings 304 keeps the toy flying. However, if one was to make the toy too light, it could actually damage the user's arm. It was discovered through testing that footballs with weights around 150 grams were too light and it would create physical damage from throwing one's arm out. You could actually feel small tears in the arm ligaments from throwing various football products after just a couple throws. It was found that having a weight around 300 grams was optimal such that it was easy to throw and yet did not cause any damage to the arm of the user.

In efforts to keep the weight down, the rear section 310 can be a lighter material. For instance, the rear section 310 can be EPP, EPS or EPO. These materials are expanded foam polymers that are rigid while being extremely light. However, these materials would not work well for the front end 311 of the body 306 because they would rip and tear far too easily. The density of the rear section 310 should be at or below 2.0 lbs. per cubic feet. EPP has a density of 1.3 lbs. per cubic feet and is preferred.

It was also discovered that the laces 340 on the rear section 310 were susceptible to ripping, tearing and destruction from the user's hand during the process of throwing. This is because the EPP foam that made up the rear section 310 would wear prematurely. A solution is to place a flexible polymer sticker over this area to provide increased support and increased durability while not increasing the overall weight of the product.

As best can be seen in FIGS. 39 and 40 and to keep the weight of the toy 300 down, it is better to optimize the shapes of the front and rear sections of the body 306 such that the front section 308 has a smaller volume than compared to the rear section 310. The front section 308 should have a maximum of at least half the volume of the rear section 310. This means the rear section 310 has at least double the volume of the front section 308. Even more optimal the front section 308 should have a maximum of at least one third of the volume of the rear section 310. This means the rear section 310 has at least three times the volume of the front section 308. This particular embodiment has a rear section 310 with a volume of 72 square inches where the front section 308 only has a volume of 21 square inches. This means that the rear section 310 has about 3.4 times the volume as compared to the front section 308.

The support 302 extends along the longitudinal axis 312 beyond the back end 313 of the body 306. The support 302 is a frame for the whole structure, tying all the parts and pieces together in a fixed (non-movably) and controlled relationship. The support 302 has a first end 303 that is disposed within the body 306. The support 302 does not extend outwardly from the front section 308, the front end of the body 311 or from the front end of the toy 315. The support 302 has a second end 305 that is disposed behind the body 306 and extends beyond the back end 313 of the body.

The support 302 experiences a tremendous amount of abuse and shock loads but must remain light and rigid. The use of a thin-walled, hollow aluminum tube was the best choice after significant trial and error. The diameter of the tube is also important. In this embodiment, the aluminum tube comprises a circular cross-section and comprises an outer diameter of at least 15 mm or greater. As the outer diameter increases so does the strength and stiffness. 10 mm diameter tubes were used but kept breaking. The amount of failure was reduced when the outer diameter was increased to 15 mm. Furthermore, the alloy of aluminum used is also 7075-T6 or stronger. This is a very high quality aluminum that is extremely strong. This is needed because other alloys of aluminum would still break and fail. Other cross-sectional shapes of the aluminum tube could be used, such as rectangular, square, hexagon, octagon or other variations thereof. This teaching is not limited to just the use of a circular cross-section.

A floor stand 342 is attached to a bottom 317 of the body 306, where the floor stand 342 is configured to stabilize the toy in a fixed position when the toy is placed upon a generally horizontal surface. (The bottom 317 is opposite the top of the body 321.) This is because the floor stand 342 has two protrusions 343 extend outwardly. It is critical that the protrusions 343 are smoothly shaped such that they don't cut or puncture a user's hands when the user is attempting to catch the toy 300.

The lift-generating wing 304 defines a wing centerline 344, where the wing centerline 344 is generally parallel to the longitudinal axis. The wing centerline 344 is right down the middle of wing 304 centered between the left and right parts of the wing 304. It has been discovered through significant trial and error testing that it is optimal if the wing centerline 344 of the lift-generating wing 306 is disposed at least 3 inches above the longitudinal axis 312. Having a relatively high wing centerline 344 creates an inherent stability of the toy in flight and also places the wings above the user's head when the product is thrown. This significantly makes the toy 300 easier to throw as one does not need to side-arm the toy 300 resulting in an awkward throwing movement.

The lift-generating wing 304 also has a dihedral angle of at least 10 degrees, or more optimally at least 15 degrees. The embodiments shown herein have 17 degrees of dihedral angle. As previously discussed, the dihedral angle increases the stability of the toy in flight and is actually 17 degrees. This means that each side of the wing 304 is rotated up about the wing centerline 344 from a horizontal plane 17 degrees. It is understood by those skilled in the art that dihedral angles of 5, 10, 15, 20, 25 or 30 may be used.

A horizontal stabilizer 346 is disposed behind the lift-generating wing. The horizontal stabilizer 346 comprises a downward force producing horizontal stabilizer 346 which creates a nose-up pitch of the toy 300 in flight. It was found optimal to create a toy 300 with a natural tendency to dive downwards in flight, or pitch downward in flight. Then the horizontal stabilizer 346 can be trimmed by the user to balance the toy 300 for their individual throwing style and ability.

When a wing is producing lift, its forces can be simplified to have a lift component upwards and a moment component pitching forward. A wing does not just generate a lift component, as the moment component is not intuitive to understand. To balance the moment component one could adjust the center of gravity 348 of the overall toy by moving it forwards and backwards with respect to the longitudinal axis. This usually means moving the wings relative to the rest of the body or structure. However, moving the wings is very difficult in a toy that needs to withstand repeated crashes and yet still produce reliable and repeatable alignment crash after crash. Also, the amount of balance may be different from one person to another due to the different throwing styles and different throwing velocities.

A better solution as compared to moving structures along the longitudinal axis 312 is to use a manual adjuster 350 associated with just the horizontal stabilizer 346. The manual adjuster 350 controls a shape of the horizontal stabilizer 346. The manual adjuster 350 is mechanically engaged between the horizontal stabilizer 346 and the support 302 as best seen in FIG. 50. The manual adjuster 350 may be a hand-turnable threaded fastener such as a thumb screw or a wing nut. The manual adjuster 350 can be threaded into a nylon-insert/locknut 351 that is captured by the horizontal stabilizer 346. As a user turn the thumb screw 350 it threadably engages the nut 351 and forces the thumb screw down causing the back end of the horizontal stabilizer 346 to rise because the thumb screw is already pressing against the support 302.

The nut 351 can be captured by a nut recess 352. This is best seen in FIG. 46 of the '563 application where the top of the horizontal stabilizer 346 has two nut recesses 352 to capture a nut 351 therein. As can be seen, the shape of the nut recess 352 prevents rotation of the nut 351 itself. Also shown herein are two apertures 353 which are configured to engage into a wall stand (not shown) that is mounted to a wall. In this way the toy 300 can be placed vertically along a wall which allows easy storage when not in use.

To help keep the horizontal stabilizer 346 biased against the support 302, a notch 349 is formed such that a rubber band may be placed within and secured around the support 302. Other biasing mechanisms may be used such as springs or magnets, however a rubber band is cheap, easily available and easy to secure.

As best seen in FIG. 47 of the '563 application, the back end 313 of the body 306 or back section 310 of the body 306 includes a push surface 354. The push surface 354 is generally perpendicular to the longitudinal axis 312. The push surface 354 is pivotably or rotatably coupled to the body 306 or to the support 304, where the push surface 354 can pivot or rotate about an axis generally parallel to the longitudinal axis 312 while the push surface 354 is also fixed in translation in relation to the longitudinal axis 312.

A user places his first finger and middle finger upon the push surface 354. The fingers will split the support 302. The thumb and other fingers will grip the rest of the body 306. As seen in FIG. 47, the push surface 354 is already rotated about the longitudinal axis. It was discovered through trial and error testing that when throwing the toy 300, many users will impart a spin to the toy 300. It is inherent in the throwing motion of most people to spin a ball when thrown. However, imparting a spin into this particular embodiment shown in FIGS. 39-50 is unwanted. Therefore as a person throws the toy 300, the two fingers upon the push surface 354 impart the energy forward to create flight. The rotatable push surface 354 cancels any spin that may or may not be imparted to the toy 300 when thrown. This is because the push surface 354 is part of a spinner 356.

The spinner 356 may also capture a bearing 357 to help create a smooth rotation or pivot about its axis of rotation. It is also possible to remove the bearing 357 so that the spinner 356 still rotates about the support 302. It is also possible to use two bearings 357 on either side of the spinner 356. This particular embodiment only uses one bearing 357.

The bearing 357 also presses against a rear brace 358. The rear brace 358 is secured to the support 302. As shown herein the rear brace 358 slides upon the support 302 and then is fixed to the support 302. The rear brace 358 captures the rear section 310 of the body 306 during assembly of the toy 300.

As best shown in FIG. 49, a center of gravity 348 is shown. It is optimal if the distance along the longitudinal axis 312 between the push surface 354 and the center of gravity 348 has a distance 359 which is zero. However, it is still acceptable if the distance 359 is 0.5 inches or even 1.0 inch. When the distance 359 is well above 1.0, throwing the toy 300 becomes difficult.

The push surface 354 should also have enough surface area for at least one finger to push thereon. Therefore, the push surface 354 should have an area of at least 1.0 square inch. Preferably the push surface 354 should have an area of at least 2.0 square inches such that two fingers may be used to propel the toy 300.

Wings (airfoils) are defined as having a leading edge and a trailing edge. The straight distance between the two edges is the cord length. A wing has a curve it follows when moving from the leading edge to the trailing edge. This curve is called the camber line/curve or just camber. The thickness of the wing is centered about the camber curve. Most wings have a substantial thickness to them. RC aircraft can use a foamed wing structure to provide rigidity since the thickness is quite substantial. Other RC aircraft use balsa-wood, composites, or carbon fiber with laminates stretched overtop to create the thickness of the wings. No matter the wing design for various RC aircraft, none have been designed to withstand the repeated abuse that a football would encounter. The wings needed to be durable enough such that they could take repeated crashes without damage and return to their preformed shape instantaneously for the next throw. The solution then was to use a thin section, injection molded, non-foamed, polymer wing and non-movably mount it to either the body 306 or the support 302. Therefore, the lift-generating wing 304 comprises a generally convex upper surface 360 opposite a generally concave lower surface 362, where the upper and lower surfaces define a wing thickness. The wing thickness is less than 0.10 of an inch. In this particular embodiment, the thickness is about 0.07 to 0.09 inches at the base and reduces to about 0.5 to 0.03 inches at the wing tips. The wing 306 is flexible enough that it deforms upon impact yet retains its shape in flight. The wing 306 is also relatively cheap to produce as it is a single material (non-composite) type of non-foamed polymer such as ABS. Accordingly, the wing 306 is an injection molded, non-foamed, polymer wing.

As best seen in FIGS. 39 and 49 of the '563 application, an impact transfer surface 364 is attached directly to the support 302. The impact transfer surface 364 is shown as a surface of an impact transfer part 365. The impact transfer surface 364 is disposed within the body 306 and disposed between the front end 311 of the body 306 and the support 302. The impact transfer surface 364 abuts an inside surface of the front section 308. Then the impact transfer part 365 is attached directly to the support 302 with either a fastener, adhesive or the like. When the toy 300 impacts an object, such as the ground or a tree, the impact force is transmitted from the front section 308 directly into the impact transfer surface 364 and impact transfer part 365 and then the impact force is transmitted directly to the support 302. Impact forces are then not transmitted to the rear section 310 of the body 306 or to the spinner 356.

Furthermore, the horizontal stabilizer 346 is disposed behind the lift-generating wing 304, where the horizontal stabilizer 346 is attached directly to the support 302. This allows the energy stored in the horizontal stabilizer 346 to be transferred directly along the support 302. Furthermore, a vertical stabilizer 366 is disposed behind the lift-generating wing 304, where the vertical stabilizer 366 is attached directly to the support 302. Again, this allows the energy stored in the vertical stabilizer 366 to be transferred directly along the support 302. As shown herein, the horizontal stabilizer 346 and the vertical stabilizer 366 both comprise an injection molded, non-foamed, polymer stabilizer.

The impact transfer surface 364 is generally perpendicular to the longitudinal axis 312. The impact transfer surface 364 optimally has an impact area of at least 2.5 square inches, where the impact area faces the front end 311 of the body 306. However, one could shape the impact transfer surface 364 in a multitude of shapes including spheroidal, football shaped, slanted, angled or any other shape that still sufficiently transfers impact energy from the front section 308 to the support 302.

As is best seen in FIG. 41 of the '563 application, the wing 304 is attached to the support 302 through a wing bracket 368. The wing bracket 368 is shown herein to slide overtop the support 302. A screw and fastener can then be used to permanently fix the bracket 368 relative to the support 302. The wing bracket 368 should be made from a high-impact resistance material such as polycarbonate. This is because a lot of force is transmitted through the bracket 368 during a crash and polycarbonate has a high impact resistance.

The wing bracket 368 is attached to the support 302 behind the back end of the body 313. The wing bracket 368 then extends upwards to attach the wing 304. As can be seen, the wing 304 and body 306 are separately disposed. This means that an outside contiguous envelope of the body 306 does not coincide with any portion of an outside contiguous envelope of the lift-generating wing 304. This design assists the user to catch the toy 300 because the whole body 306 may be grabbed at any angle without having to worry about a portion of the toy 300 getting in the way. This is also why the wings 304 are disposed behind the center 319 of the body 306 and above the longitudinal axis 312.

The lift-generating wing 304 is non-movably attached to the support by a non-pivotable and non-rotatable male-to-female connection 370, where a male portion 372 of the male-to-female connection 370 is configured to non-pivotably and non-rotatably engage into a female portion 374 of the male-to-female connection 370, where the lift-generating wing 304 comprises one of either the male portion or the female portion and the support 302 or wing bracket 368 comprises the other of the male portion or female portion. As shown herein, the bracket 368 has the male portion 372 and the wing 304 includes the female portion 374. Here a shape of an oval is used. An oval placed inside an oval is not capable of rotation or pivoting. The wing 304 can then be held attached to the bracket 368 with a fastener and a nut. In this way, impact forces are transmitted from the structures of the male-to-female connection 370 and are not transmitted directly to the fasteners. Using fasteners to absorb the impact loads would lead to premature failure and parts breaking too quickly. The bracket 368 has two recesses 376 that are sized to capture a nut such that a separate tool is not needed to hold the nut during assembly. This is done to simplify the assembly process and reduce the number of tools needed for assembly.

As best seen in FIG. 47, the spinner 356 has finger extensions 378 extending in a direction aligned with the longitudinal axis. When a user places their fingers on the finger push surface 354 it is critical that the fingers don't extend over the edge of the spinner 356. Therefore, the finger extensions 378 block the fingers from being placed above the correct location or sliding above the correct location.

Although several embodiments of the throwing and catching flying toy 300 have been described in detail for purposes of illustration, various modifications may be made to each without departing from the scope and spirit of the invention. Accordingly, the invention is not to be limited, except as by the appended claims.

SUMMARY OF THE INVENTION

An exemplary embodiment of a throwing and/or catching toy includes a generally elongated spheroidal body defined as comprising a longitudinal axis. A length of the body along the longitudinal axis between a front end of the body to a back end of the body is longer than an equatorial diameter. The equatorial diameter of the body is at least 2.0, 2.5, 3.0, 3.5, 4.0 and/or 4.5 inches. A lift-generating wing is non-movably attached to the body near and/or at a center of the wing. The wing has a left wing portion and a right wing portion extending from the center of the wing. At least one finger hold extension extends from a distal end of either the left wing portion or right wing portion. The finger hold extension is configured to allow a user to throw the toy in a discus-launched manner and the body is configured to be caught by the user.

In other embodiments, at least a portion of the front end of the body may comprise a resilient foam having a Shore A durometer hardness substantially equal to or less than 25.

The body may be football shaped.

An overall weight of the toy may be less than 400 grams.

A floor stand may be attached to a bottom of the body, where the floor stand is configured to stabilize the toy in a fixed position when the toy is placed upon a generally horizontal surface.

The lift-generating wing may comprise a dihedral angle of at least 5 degrees, the dihedral angle measured from either the left wing portion or right wing portion relative to a generally horizontal surface.

The lift-generating wing may comprise a generally convex upper surface opposite a generally concave lower surface, where the upper and lower surfaces define a wing thickness, where the wing thickness over a majority of the lift-generating wing is less than 0.10 of an inch.

The lift-generating wing may comprise an injection molded, non-foamed, polymer wing.

An exemplary embodiment of throwing and/or catching toy includes an elongated body defined as comprising a longitudinal axis along a length of the body, wherein a largest width of the body is at least 3.0 inches. A support is non-movably attached to the body, where a first end of the support is attached to the body and a second end of the support extends along the longitudinal axis beyond a back end of the body. A lift-generating wing is non-movably attached to the support near and/or at a center of the wing, the wing having a left wing portion and a right wing portion extending from the center of the wing. A horizontal stabilizer and a vertical stabilizer are attached to the support near the second end of the support, where the horizontal stabilizer and vertical stabilizer are disposed behind the lift-generating wing. At least one finger hold extension extends from a distal end of either the left wing portion or right wing portion, the finger hold extension configured to allow a user to throw the toy in a discus-launched manner and the body configured to be caught by the user.

In other embodiments, the body is comprised of a front section abutting a rear section. The front section and rear section comprise different materials. The front comprises a resilient foam having a Shore A durometer hardness equal to or less than 25. A rear section volume of the rear section is at least double a front section volume of the front section.

An impact transfer surface may be attached directly to the first end of the support and abutting an inside surface of the front section of the body, wherein the impact transfer surface is generally perpendicular to the longitudinal axis, and wherein the impact transfer surface comprises an impact area of at least 2.5 square inches.

The lift-generating wing may be disposed behind the center of the body in relation to along the longitudinal axis, wherein an outside contiguous envelope of the body does not coincide with any portion of an outside contiguous envelope of the lift-generating wing, wherein the body and lift-generating wing are separately disposed and attached to the support.

The support may comprise a hollow aluminum tube. The aluminum tube may comprises a circular cross-section and comprises an outer diameter of at least 15 mm or greater.

A manual adjuster may be associated with the horizontal stabilizer, the manual adjuster controlling a shape of the horizontal stabilizer, where the manual adjuster is mechanically engaged between the horizontal stabilizer and the support. The manual adjuster may comprise a hand-turnable threaded fastener.

The lift-generating wing may comprise a generally convex upper surface opposite a generally concave lower surface, where the upper and lower surfaces define a wing thickness, where the wing thickness over a majority of the lift-generating wing is less than 0.10 of an inch. The lift-generating wing may comprise an injection molded, non-foamed, polymer wing. The horizontal stabilizer and the vertical stabilizer both may comprise an injection molded, non-foamed, polymer stabilizer.

An exemplary embodiment of a throwing and/or catching toy includes an elongated body defined as comprising a longitudinal axis along a length of the body, wherein at least a portion of a front end of the elongated body comprises a resilient foam having a Shore A durometer hardness equal to or less than 25. A support is non-movably attached to the body, where a first end of the support is attached to the body and a second end of the support extends along the longitudinal axis beyond a back end of the body. A lift-generating wing is non-movably attached to the support near and/or at a center of the wing, the wing having a left wing portion and a right wing portion extending from the center of the wing. A horizontal stabilizer and a vertical stabilizer are attached to the support near the second end, where the horizontal stabilizer and vertical stabilizer are disposed behind the lift-generating wing. At least one finger hold extension extends from a distal end of either the left wing portion or right wing portion, the finger hold extension configured to allow a user to throw the toy in a discus-launched manner and the body configured to be caught by the user.

An exemplary embodiment of a throwing and/or catching toy includes an elongated body defined as comprising a longitudinal axis along a length of the body. A support is non-movably attached to the body, where a first end of the support is attached to the body and a second end of the support extends along the longitudinal axis beyond a back end of the body. A lift-generating wing non-movably attached to the support near and/or at a center of the wing, the wing having a left wing portion and a right wing portion extending from the center of the wing. A horizontal stabilizer and a vertical stabilizer are attached to the support near the second end, where the horizontal stabilizer and vertical stabilizer are disposed behind the lift-generating wing. At least one finger hold extension extends from a distal end of either the left wing portion or right wing portion, the finger hold extension configured to allow a user to throw the toy in a discus-launched manner and the body configured to be caught by the user. A manual adjuster is associated with the horizontal stabilizer, the manual adjuster controlling a shape of the horizontal stabilizer, where the manual adjuster is mechanically engaged between the horizontal stabilizer and the support. The manual adjuster may comprise a hand-turnable threaded fastener.

An exemplary embodiment of a throwing and/or catching toy includes an elongated body defined as comprising a longitudinal axis along a length of the body. A support is non-movably attached to the body, where a first end of the support is attached to the body and a second end of the support extends along the longitudinal axis beyond a back end of the body. A lift-generating wing is non-movably attached to the support near and/or at a center of the wing, the wing having a left wing portion and a right wing portion extending from the center of the wing. A horizontal stabilizer and a vertical stabilizer are attached to the support near the second end, where the horizontal stabilizer and vertical stabilizer are disposed behind the lift-generating wing. At least one finger hold extension extends from a distal end of either the left wing portion or right wing portion, the finger hold extension configured to allow a user to throw the toy in a discus-launched manner and the body configured to be caught by the user. The lift-generating wing comprises an injection molded, polymer wing, wherein the lift-generating wing comprises a generally convex upper surface opposite a generally concave lower surface, where the upper and lower surfaces define a wing thickness, where the wing thickness over a majority of the lift-generating wing is less than 0.10 of an inch.

In other exemplary embodiments, the at least one finger hold extension may comprise an upper extension and a lower extension, where the upper extension extends generally perpendicular from the convex upper surface and the lower extension extends generally perpendicular from the concave lower surface. Each of the upper and lower extensions may have a vertical end which is generally perpendicular to their respective wing surfaces, wherein the vertical end of the upper extension is disposed behind the vertical end of the lower extension in a direction parallel to the longitudinal axis where a front of the toy is defined near the body and a rear of the toy is defined near the horizontal and vertical stabilizers.

BRIEF DESCRIPTION OF THE DRAWINGS

The accompanying drawings illustrate the invention. In such drawings.

DETAILED DESCRIPTION OF THE PREFERRED EMBODIMENTS

The background of this patent application discussed the various designs and features of a flying football disclosed in previous application. The new embodiments disclosed herein are also directed to a flying football but one which is thrown in a different manner. Therefore, all of the lessons taught in the previous applications can be applied to these new embodiments disclosed herein. Furthermore, many of the numerals applied to the various parts shown herein are reused to remain consistent with the previous applications.

One segment of popularity is the rise of hand launched gliders, which are commonly known as discus launched gliders, or DLGs for short. A discus launched glider is a radio controlled aircraft that lacks an engine. The user launches the RC glider by flinging the glider into the air using the rotation of the body and arm combined with the throwing ability of the user. Once in the air, the glider can be controlled via a transmitter such that extended flight times are achieved. Accordingly, the inventor has created a new flying football which can be thrown in a manner similar to how a discus launched glider can be thrown.

Figure 1:
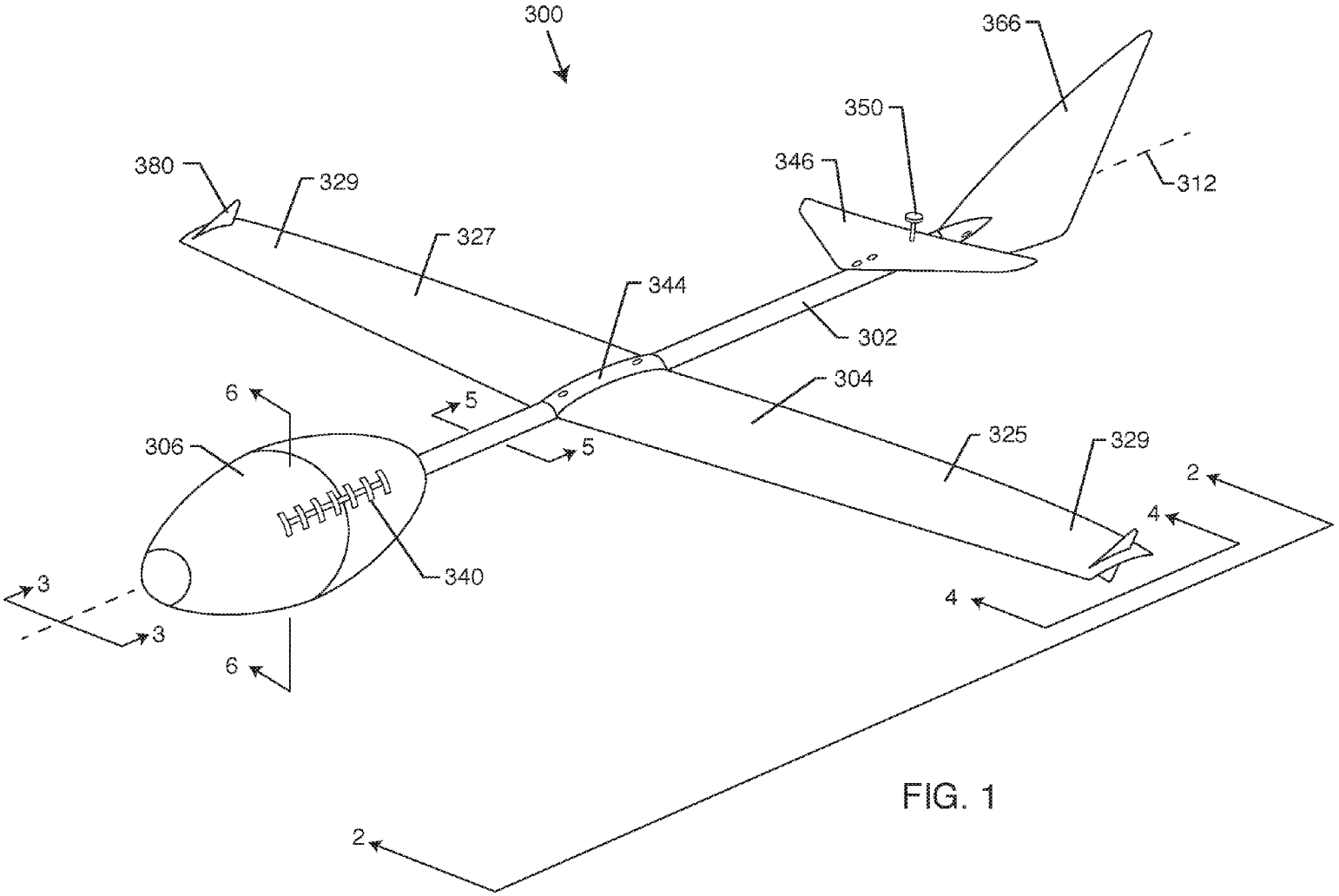
FIG. 1 is a perspective view of an exemplary self-propelled flying toy embodying the present invention.
Figure 2:
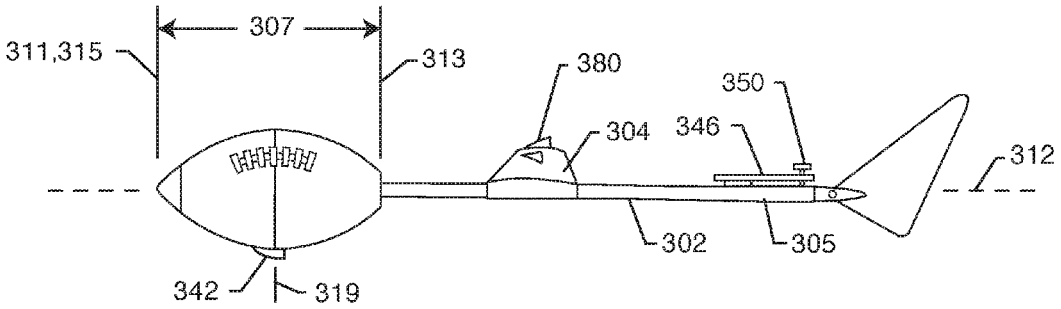
FIG. 2 is side view of the toy taken along lines 2-2 from FIG. 1.
Figure 3:
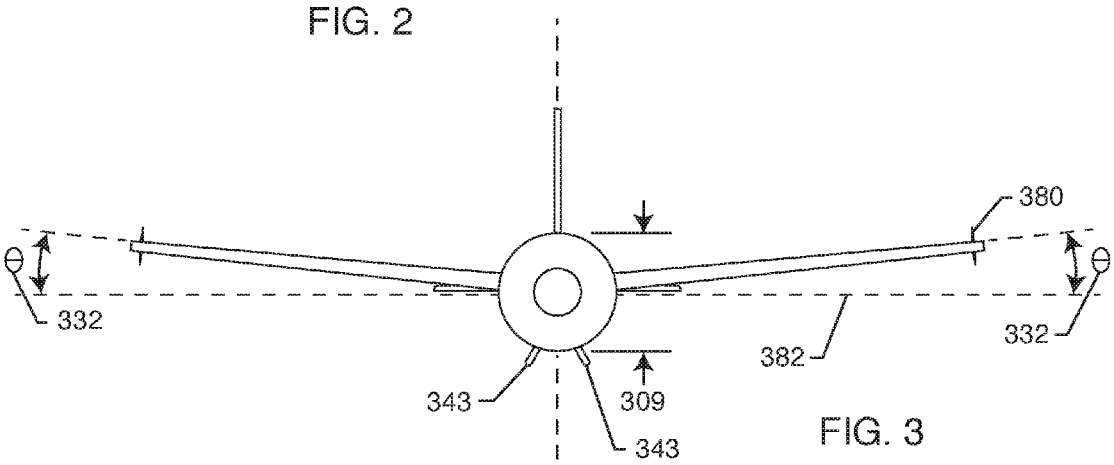
FIG. 3 is a front view of the toy taken along lines 3-3 from FIG. 1.

FIGS. 1-3 show a new embodiment of the throwing and/or catching flying toy 300. The toy 300 includes a generally elongated spheroidal body 306 defined as comprising a longitudinal axis 312. A length 307 of the body along the longitudinal axis between a front end 311 of the body to a back end 313 of the body is longer than an equatorial diameter 309, where the equatorial diameter may simply be the widest portion (largest width) of the body. The equatorial diameter of the body may be at least 2.0, 2.5, 3.0, 3.5, 4.0 and/or 4.5 inches.

A lift-generating wing 304 is non-movably attached to the body near and/or at a center 344 (centerline) of the wing. The wing has a left wing portion 325 and a right wing portion 327 extending from the center 344 of the wing 304. At least one finger hold extension 380 extends from a distal end 329 of either the left wing portion or right wing portion. The finger hold extension 380 is configured to allow a user to throw the toy 300 in a discus-launched manner and the body is configured to be caught by the user.

In other embodiments, at least a portion of the front end 311 or a front section/portion 308 of the body may comprise a resilient foam having a Shore A durometer hardness substantially equal to or less than 25. As shown in these embodiments, the body 306 may be football shaped. Furthermore, an overall weight of the toy 300 may be less than 400 grams, or in other embodiments even less than 350 grams, 300 grams, or 250 grams.

A floor stand 342 may be attached to a bottom 317 of the body, where the floor stand is configured to stabilize the toy in a fixed position when the toy is placed upon a generally horizontal surface. The floor stand 342 can include two protrusions 343 such that the protrusions 343 can act like a stand when the toy 300 is placed on the generally horizontal surface. The floor stand 342 also acts as protection for the body of the football such that when the product comes into contact with the ground, the floor stand contacts damaging surfaces first, such as sidewalks, roads and driveways. If not for the floor stand 342, the body 306 would be grated quickly by such rough surfaces.

The lift-generating wing 304 may comprise a dihedral angle 332 of at least 5, 10, 15, 20, 25 or more degrees. The dihedral angle 332 is measured from the angle of either the left wing portion or right wing portion relative to a generally horizontal surface 382. Furthermore, the lift-generating wing 304 may comprise a generally convex upper surface 360 opposite a generally concave lower surface 362, where the upper and lower surfaces define a wing thickness, where the wing thickness over a majority of the lift-generating wing is less than 0.10 of an inch. In other words, the lift-generating wing may comprise an injection molded, non-foamed, polymer wing.

An exemplary embodiment includes a support 302 which is non-movably attached to the body. A first end 303 of the support 302 is attached to the body and a second end 305 of the support 302 extends along the longitudinal axis 312 beyond the back end 313 of the body. The lift-generating wing 304 can then be non-movably attached to the support 302 near and/or at the center of the wing (wing centerline 344). The horizontal stabilizer 346 and the vertical stabilizer 366 are then attached to the support 302 near the second end 305 of the support. The horizontal stabilizer and vertical stabilizer are disposed behind the lift-generating wing. At least one finger hold extension 380 extends from the distal end 329 of either the left wing portion or right wing portion. The finger hold extension 380 is configured to allow a user to throw the toy in a discus-launched manner and the body configured to be caught by the user.

In other embodiments, the body 306 is comprised of a front section 308 abutting a rear section 310. The front section and rear section may comprise different materials.

For example, the front section may comprise a resilient foam having a Shore A durometer hardness equal to or less than 25. Then the rear section can comprise a lighter material such as EPP, EPS or EPO. To help minimize weight, a rear section volume of the rear section 310 may be at least double a front section volume of the front section 308.

An impact transfer surface 364 may be attached directly to the first end of the support and abutting an inside surface 323 of the front section of the body. The impact transfer surface 364 may be made from an injection molded part that is fastened or bonded onto the structural support 302. The impact transfer surface 364 is generally perpendicular to the longitudinal axis 312. The impact transfer surface 364 may comprise an impact area of at least 2.5 square inches.

The lift-generating wing 304 may be disposed behind the center of the body 306 in relation to along the longitudinal axis, wherein an outside contiguous envelope of the body 306 does not coincide with any portion of an outside contiguous envelope of the lift-generating wing 304. In other words, the body and lift-generating wing are separately disposed and attached to the support 302.

The support 302 may comprise a hollow aluminum tube. Other metals could be used, but aluminum is a very light while strong metal. It is also worth noting that there are different alloys and heat treatments of aluminum available. The inventor has selected a 7075-T6 alloy of aluminum which has two advantages. First, the 7075-T6 is one of the strongest alloys of aluminum used which then gives the product exceptional strength and durability. Second, 7075 alloys are exempt from certain tariffs when manufactured overseas and imported into the United States. Other alloys of aluminum can experience a factor of four times the cost just in anti-dumping tariffs. Anyone who imports aluminum parts into the United States should research whether such tariffs could detrimentally impact their parts. Beyond aluminum, other materials could be used such as composites or carbon fiber to form the support 302.

The aluminum tube may comprise a circular cross-section and comprise an outer diameter of at least 15 mm or greater. This is best seen in FIGS. 5A-5D, which show various ways and methods the wings 304 may be attached to the tube 302.

Figure 5A:
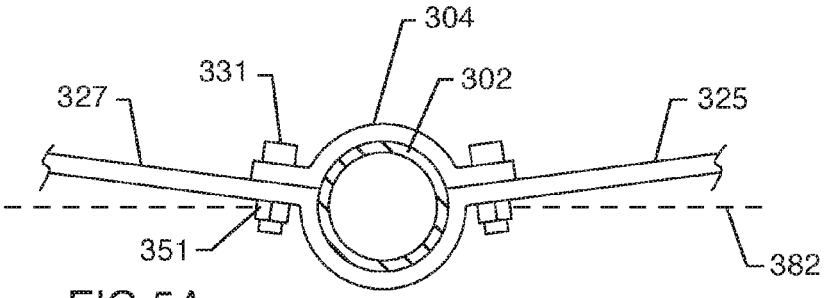
FIG. 5A is a sectional view of one embodiment taken along lines 5-5 of FIG. 1.

As shown in FIG. 5A, the wings 304 comprise two separately manufactured parts, a left wing portion 325 and a right wing portion 327. This is because it may be too costly and difficult to manufacture the wings 304 as one large part. Therefore the wing 304 is broken into two parts that are then held together with fasteners 331 and nuts 351.

Figure 5B:
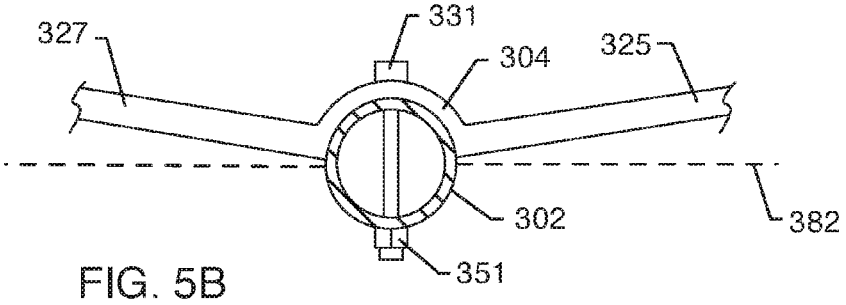
FIG. 5B is a sectional view of another embodiment taken along lines 5-5 of FIG. 1.

FIG. 5B shows an embodiment where the wing 304 is manufactured as one continuous part.

Figure 5C:
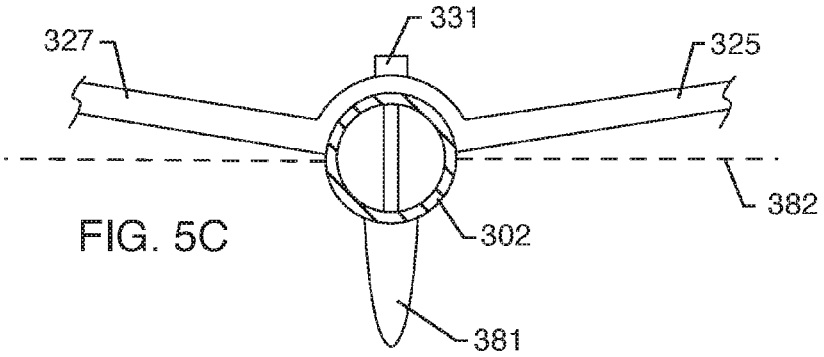
FIG. 5C is a sectional view of another embodiment taken along lines 5-5 of FIG. 1.

FIG. 5C is similar to FIG. 5B, but now shows a counterweight 381. It may be important to have the center of gravity of the whole toy 300 to coincide with the longitudinal axis 312, or as shown, with the generally horizontal plane 382. The counterweight 381 helps to pull the overall center of gravity of the toy 300 downward such that it aligns with the longitudinal axis 312. This can be accomplished by having the counterweight disposed below the toy 300 such that balances the wings 304 which are disposed generally above the longitudinal axis 312. The counterweight may be made of a polymer, but also may be made of a denser material, such as a metal.

Figure 5D:
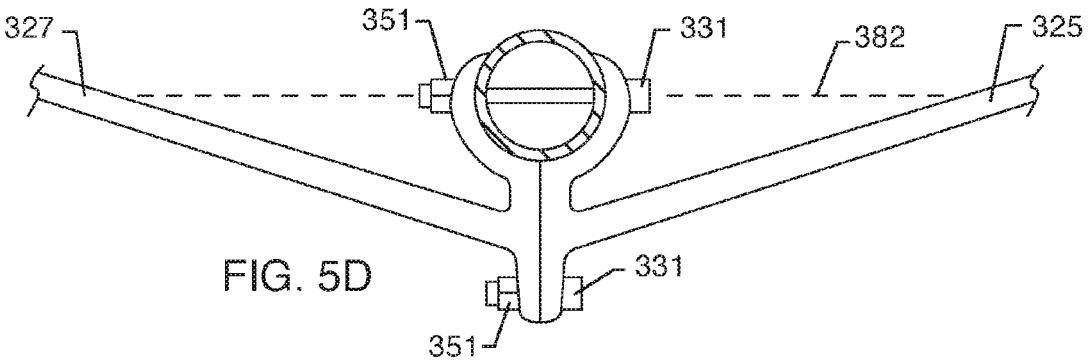
FIG. 5D is a sectional view of another embodiment taken along lines 5-5 of FIG. 1.
Figure 6:
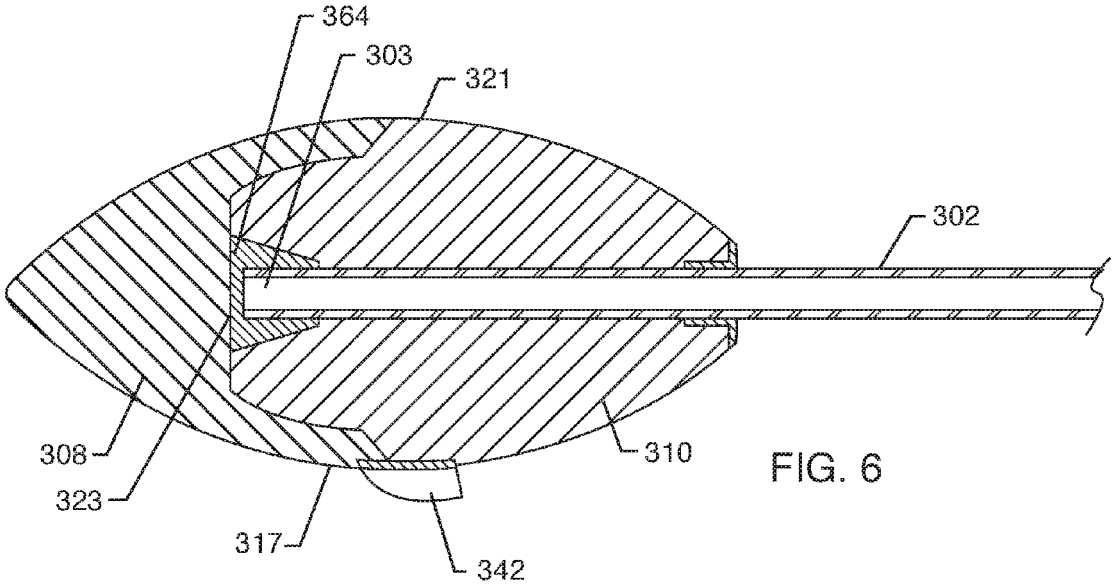
FIG. 6 is an enlarged sectional side view taken along lines 6-6 of FIG. 1.

FIG. 5D eliminates the counterweight 381 as a separate part but achieves an aligned center of gravity by disposing a portion of the wings below the longitudinal axis 312/horizontal plane 382.

A manual adjuster 350 may be associated with the horizontal stabilizer. The manual adjuster 350 controls a shape of the horizontal stabilizer, where the manual adjuster is mechanically engaged between the horizontal stabilizer and the support. The manual adjuster may comprise a hand-turnable threaded fastener.

Figure 4:
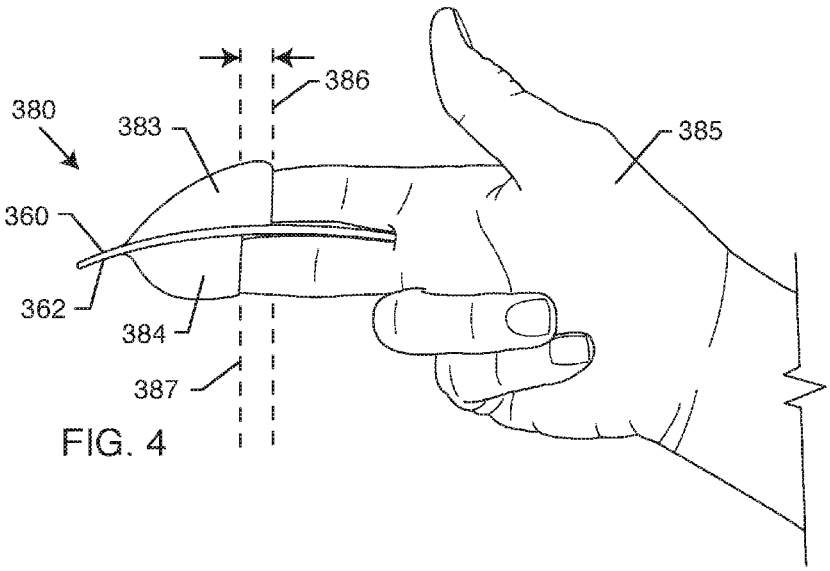
FIG. 4 is an enlarged side view of the finger hold extensions taken along lines 4-4 from FIG. 1 now showing a hand gripping the upper and lower extensions which extend perpendicular from the wing tips.
Figure 7:
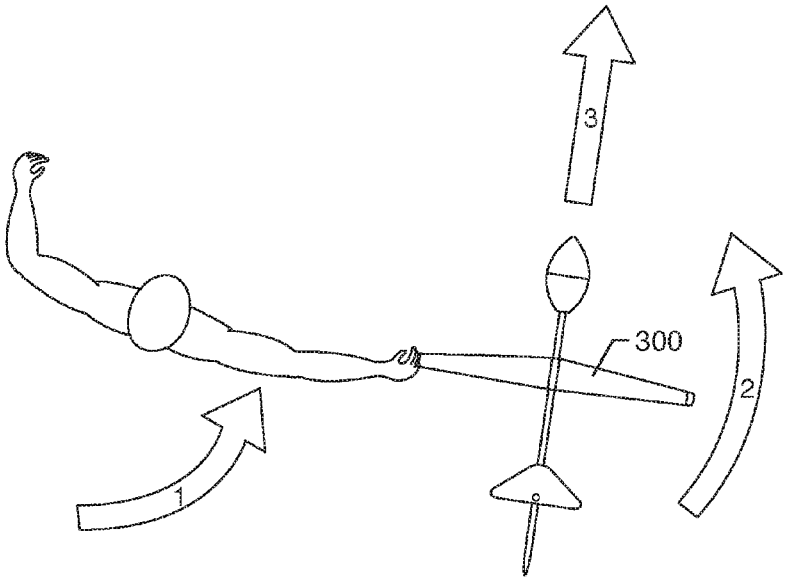
FIG. 7 is a top view of a user throwing the toy in a discus-launched manner.

As best seen in FIG. 4, the at least one finger hold extension 380 extends from a distal end 329 of either the left wing portion 325 or right wing portion 327, where the at least one finger hold extension 380 may comprise an upper extension 383 and a lower extension 384. The upper extension 383 extends generally perpendicular from the convex upper surface 360 and the lower extension 384 extends generally perpendicular from the concave lower surface 362. As can be seen, the user's hand 385 is placed at the distal end of the wing, and the fingertips of the first and second fingers engage the finger hold extensions. This then allows the user, as shown in FIG. 7, to spin around in motion one and then twist their wrist in motion two to finally launch the toy 300 in motion three. The advantage of this throwing technique is that a higher exit velocity of the toy 300 can be achieved due to the increased motion arm that is created from the user's body down to the center of the toy 300. Essentially the left wing portion acts as a lever which increases the exit velocity.

In a further refinement of the finger hold extensions, as shown in FIG. 4 again, each of the upper and lower extensions may have an unaligned vertical end which is generally perpendicular to their respective wing surfaces. This is because the joints of the human hand do not align perfectly. The last joint of the first and second fingers are usually spaced a distance apart. Therefore, the finger hold extension has been configured to facilitate this. As shown, the vertical end 386 of the upper extension 383 is disposed behind the vertical end 387 of the lower extension 384 in a direction parallel to the longitudinal axis where a front 315 of the toy is defined near the body and a rear of the toy is defined near the horizontal and vertical stabilizers. The gap between the vertical ends 386 and 387 can be more than 0.125 inches, 0.25 inches or 0.5 inches.

As shown herein, the body 306 is football shaped. Those skilled in the art will understand from this teaching that other shapes are possible, such shapes including baseballs, softballs, missiles, rockets, futuristic shapes or any other shape that is aesthetically pleasing while easy to catch.

As can now be understood, the toy 300 can be played with between two people, where one person is throwing and the other person is catching. The toy 300 can be played with just one person, where they throw the toy at a target or simply throw for distance. It is also possible to design the toy 300 such that a person could throw it away and the toy 300 would turn in the air and come back to the thrower, similar in concept to how a boomerang works. This can be accomplished by adjusting the wing surfaces or adjusting the horizontal and vertical stabilizers.

NUMERALS

300 Throwing and/or Catching Flying Toy
302 Structural Support
303 First End of Support
304 Lift-Generating Wing
305 Second End of Support
306 Body
307 Length of Body
308 Front Section
309 Equatorial Diameter
310 Rear Section
311 Front End of Body
312 Longitudinal Axis

313 Back End of Body
314 Tail
315 Front End of Toy
316 Tail Fin
317 Bottom of Body
318 Tail End
319 Center of Body
320 Thumb Grip
321 Top of Body
322 Bearing
323 Inside Surface of Front Section
324 Pitch Axis
325 Left Wing Portion
326 Pivot
327 Right Wing Portion
328 Screw
329 Distal End of Wing
330 Bias
331 Fastener
332 Dihedral Angle
334 Horizontal Section
336 Dihedral Section
338 Vacuum-Formed Plastic Part
340 Laces
342 Floor Stand
343 Protrusions on Floor Stand
344 Wing Centerline
346 Horizontal Stabilizer
348 Center of Gravity
349 Notch
350 Manual Adjuster
351 Nut
352 Nut Recess
353 Wall Stand Apertures
354 Push Surface
356 Spinner
357 Bearing
358 Rear Brace
359 Distance
360 Convex Upper Surface
362 Concave Lower Surface
364 Impact Transfer Surface
365 Impact Transfer Part
366 Vertical Stabilizer
368 Wing Bracket
370 Male-to-Female Connection
372 Male Portion
374 Female Portion
376 Recess
378 Finger Extensions
380 Finger Hold Extensions
381 Counterweight
382 Horizontal Plane
383 Upper Extension, Finger Hold Extension
384 Lower Extension, Finger Hold Extension
385 User's Hand
386 Vertical End, Upper Extension
387 Vertical End, Lower Extension

What is claimed is:

1. A throwing and/or catching toy, comprising:

a generally elongated spheroidal body defined as comprising a longitudinal axis, where a length of the body along the longitudinal axis between a front end of the body to a back end of the body is longer than an equatorial diameter, wherein the equatorial diameter of the body is at least 3.0 inches;

a lift-generating wing non-movably attached to the body near and/or at a center of the wing, the wing having a left wing portion and a right wing portion extending from the center of the wing to a respective distal end; and at least one finger hold extension extending from the distal end of either the left wing portion or right wing portion, the finger hold extension configured to allow a user to throw the toy in a discus-launched manner and the body configured to be caught by the user.

2. The toy of claim 1, wherein at least a portion of the front end of the body comprises a resilient foam having a Shore A durometer hardness substantially equal to or less than 25.

3. The toy of claim 1, wherein the body is football shaped.

4. The toy of claim 1, wherein an overall weight of the toy is less than 400 grams.

5. The toy of claim 1, including a floor stand attached to a bottom of the body, where the floor stand is configured to stabilize the toy in a fixed position when the toy is placed upon a generally horizontal surface.

6. The toy of claim 1, wherein the lift-generating wing comprises a dihedral angle of at least 5 degrees, the dihedral angle measured from either the left wing portion or right wing portion relative to a generally horizontal surface.

7. The toy of claim 1, wherein the lift-generating wing comprises a generally convex upper surface opposite a generally concave lower surface, where the upper and lower surfaces define a wing thickness, where the wing thickness over a majority of the lift-generating wing is less than 0.10 of an inch.

8. The toy of claim 1, wherein the lift-generating wing comprises an injection molded, non-foamed, polymer wing.

9. A throwing and/or catching toy, comprising:

an elongated body defined as comprising a longitudinal axis along a length of the body, wherein a largest width of the body is at least 3.0 inches;

a support non-movably attached to the body, where a first end of the support is attached to the body and a second end of the support extends along the longitudinal axis beyond a back end of the body;

a lift-generating wing non-movably attached to the support near and/or at a center of the wing, the wing having a left wing portion and a right wing portion extending from the center of the wing to a respective distal end;

a horizontal stabilizer and a vertical stabilizer attached to the support near the second end of the support, where the horizontal stabilizer and vertical stabilizer are disposed behind the lift-generating wing;

at least one finger hold extension extending from the distal end of either the left wing portion or right wing portion, the finger hold extension configured to allow a user to throw the toy in a discus-launched manner and the body configured to be caught by the user.

10. The toy of claim 9, wherein the body is comprised of a front section abutting a rear section.

11. The toy of claim 10, wherein the front section and rear section comprise different materials.

12. The toy of claim 11, wherein the front comprises a resilient foam having a Shore A durometer hardness equal to or less than 25.

13. The toy of claim 11, wherein a rear section volume of the rear section is at least double a front section volume of the front section.

14. The toy of claim 10, including an impact transfer surface attached directly to the first end of the support and abutting an inside surface of the front section of the body, wherein the impact transfer surface is generally perpendicular to the longitudinal axis, and wherein the impact transfer surface comprises an impact area of at least 2.5 square inches.

15. The toy of claim 9, wherein the lift-generating wing is disposed behind the center of the body in relation to along the longitudinal axis, wherein an outside contiguous envelope of the body does not coincide with any portion of an outside contiguous envelope of the lift-generating wing, wherein the body and lift-generating wing are separately disposed and attached to the support.

16. The toy of claim 9, wherein the support comprises a hollow aluminum tube.

17. The toy of claim 16, wherein the aluminum tube comprises a circular cross-section and comprises an outer diameter of at least 15 mm or greater.

18. The toy of claim 9, including a manual adjuster associated with the horizontal stabilizer, the manual adjuster controlling a shape of the horizontal stabilizer, where the manual adjuster is mechanically engaged between the horizontal stabilizer and the support.

19. The toy of claim 18, wherein the manual adjuster comprises a hand-turnable threaded fastener.

20. The toy of claim 9, wherein the lift-generating wing comprises a generally convex upper surface opposite a generally concave lower surface, where the upper and lower surfaces define a wing thickness, where the wing thickness over a majority of the lift-generating wing is less than 0.10 of an inch.

21. The toy of claim 20, wherein the lift-generating wing comprises an injection molded, non-foamed, polymer wing.

22. The toy of claim 21, wherein the horizontal stabilizer and the vertical stabilizer both comprise an injection molded, non-foamed, polymer stabilizer.

23. A throwing and/or catching toy, comprising:

an elongated body defined as comprising a longitudinal axis along a length of the body, wherein at least a portion of a front end of the elongated body comprises a resilient foam having a Shore A durometer hardness equal to or less than 25;

a support non-movably attached to the body, where a first end of the support is attached to the body and a second end of the support extends along the longitudinal axis beyond a back end of the body;

a lift-generating wing non-movably attached to the support near and/or at a center of the wing, the wing having a left wing portion and a right wing portion extending from the center of the wing to a respective distal end;

a horizontal stabilizer and a vertical stabilizer attached to the support near the second end, where the horizontal stabilizer and vertical stabilizer are disposed behind the lift-generating wing; and at least one finger hold extension extending from the distal end of either the left wing portion or right wing portion, the finger hold extension configured to allow a user to throw the toy in a discus-launched manner and the body configured to be caught by the user.

24. A throwing and/or catching toy, comprising:

an elongated body defined as comprising a longitudinal axis along a length of the body;

a support non-movably attached to the body, where a first end of the support is attached to the body and a second end of the support extends along the longitudinal axis beyond a back end of the body;

a lift-generating wing non-movably attached to the support near and/or at a center of the wing, the wing having a left wing portion and a right wing portion extending from the center of the wing to a respective distal end;

a horizontal stabilizer and a vertical stabilizer attached to the support near the second end, where the horizontal stabilizer and vertical stabilizer are disposed behind the lift-generating wing;

at least one finger hold extension extending from the distal end of either the left wing portion or right wing portion, the finger hold extension configured to allow a user to throw the toy in a discus-launched manner and the body configured to be caught by the user; and a manual adjuster associated with the horizontal stabilizer, the manual adjuster controlling a shape of the horizontal stabilizer, where the manual adjuster is mechanically engaged between the horizontal stabilizer and the support.

25. The toy of claim 24, wherein the manual adjuster comprises a hand-turnable threaded fastener.

26. A throwing and/or catching toy, comprising:

an elongated body defined as comprising a longitudinal axis along a length of the body;

a support non-movably attached to the body, where a first end of the support is attached to the body and a second end of the support extends along the longitudinal axis beyond a back end of the body;

a lift-generating wing non-movably attached to the support near and/or at a center of the wing, the wing having a left wing portion and a right wing portion extending from the center of the wing to a respective distal end;

a horizontal stabilizer and a vertical stabilizer attached to the support near the second end, where the horizontal stabilizer and vertical stabilizer are disposed behind the lift-generating wing;

at least one finger hold extension extending from the distal end of either the left wing portion or right wing portion, the finger hold extension configured to allow a user to throw the toy in a discus-launched manner and the body configured to be caught by the user;

wherein the lift-generating wing comprises an injection molded, polymer wing, wherein the lift-generating wing comprises a generally convex upper surface opposite a generally concave lower surface, where the upper and lower surfaces define a wing thickness, where the wing thickness over a majority of the lift-generating wing is less than 0.10 of an inch.

27. The toy of claim 26, wherein the at least one finger hold extension comprises an upper extension and a lower extension, where the upper extension extends generally perpendicular from the convex upper surface and the lower extension extends generally perpendicular from the concave lower surface.

28. The toy of claim 27, wherein each of the upper and lower extensions have a vertical end which is generally perpendicular to their respective wing surfaces, wherein the vertical end of the upper extension is disposed behind the vertical end of the lower extension in a direction parallel to the longitudinal axis where a front of the toy is defined near the body and a rear of the toy is defined near the horizontal and vertical stabilizers.

* * * * *